US006572300B2

(12) United States Patent
Altonen et al.

(10) Patent No.: US 6,572,300 B2
(45) Date of Patent: Jun. 3, 2003

(54) SOFT APPLICATOR DOME

(75) Inventors: Gene Michael Altonen, West Chester, OH (US); David Scott Menk, Milford, OH (US); Scott Edward Smith, Cincinnati, OH (US); Christopher Luke Leonard, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/840,567

(22) Filed: Apr. 23, 2001

(65) Prior Publication Data

US 2002/0048483 A1 Apr. 25, 2002

Related U.S. Application Data

(60) Provisional application No. 60/199,414, filed on Apr. 24, 2000.

(51) Int. Cl.[7] ..... B05C 11/00

(52) U.S. Cl. ..... 401/266; 401/265; 401/261

(58) Field of Search ..... 401/266, 265, 401/261, 264, 196, 54, 68, 55

(56) References Cited

U.S. PATENT DOCUMENTS

| | | | | |
|---|---|---|---|---|
| 4,915,268 A | * | 4/1990 | Lay et al. | 222/498 |
| 5,064,306 A | | 11/1991 | Gueret | |
| 5,727,892 A | | 3/1998 | Baudin | |
| 5,743,441 A | | 4/1998 | Baudin et al. | |
| 6,116,803 A | * | 9/2000 | Szekely et al. | 401/266 |
| 6,196,747 B1 | * | 3/2001 | Kreiseder et al. | 401/266 |

FOREIGN PATENT DOCUMENTS

| | | |
|---|---|---|
| EP | 0 100 204 A1 | 2/1984 |
| EP | 0 687 507 A2 | 12/1995 |
| FR | 1370714 | 2/1964 |

* cited by examiner

*Primary Examiner*—David J. Walczak
(74) *Attorney, Agent, or Firm*—Jack L. Oney; Tara M. Rosnell

(57) ABSTRACT

An applicator being constructed to include a thermoplastic elastomer. In another embodiment, an applicator dome has a first material and a second material, wherein, the first material is made of a thermoplastic elastomer and the second material is made of a material having more rigidity than the first material. The second material provides structural support for the first material. In yet another embodiment, an applicator dome has a first material and a second material, wherein, the first material has a Dimethicone Droplet Spread Rate value from about 200 $mm^2$ to about 900 $mm^2$. In yet another embodiment, an applicator dome has an inward-deflection value of at least 0.17 mm. This embodiment may also include an outward-deflection value ranging from 0.000 mm to about 0.40 mm. In yet another embodiment, an applicator dome has a wet-drag value ranging from about 300 mJ to about 600 mJ. In yet another embodiment, an applicator dome has a dry-drag value ranging from about 500 mJ to about 3000 mJ. In yet another embodiment, an applicator dome has an increase in wet-drag value of at least 150 mJ after four product application strokes onto an application surface.

7 Claims, 8 Drawing Sheets

CROSS SECTIONAL VIEW OF APPLICATOR IN FIG. 3

TOP VIEW OF APPLICATOR DOME IN FIG 2

CROSS SECTIONAL VIEW OF APPLICATOR IN FIG. 3

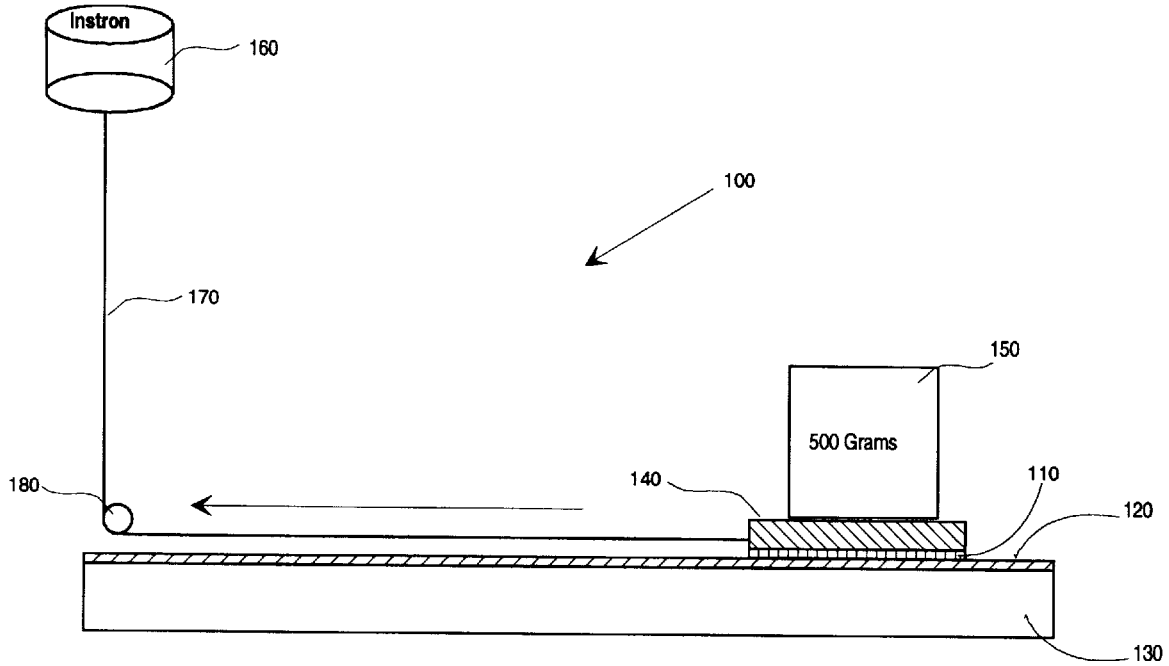
FIG. 5a Dry drag testing method
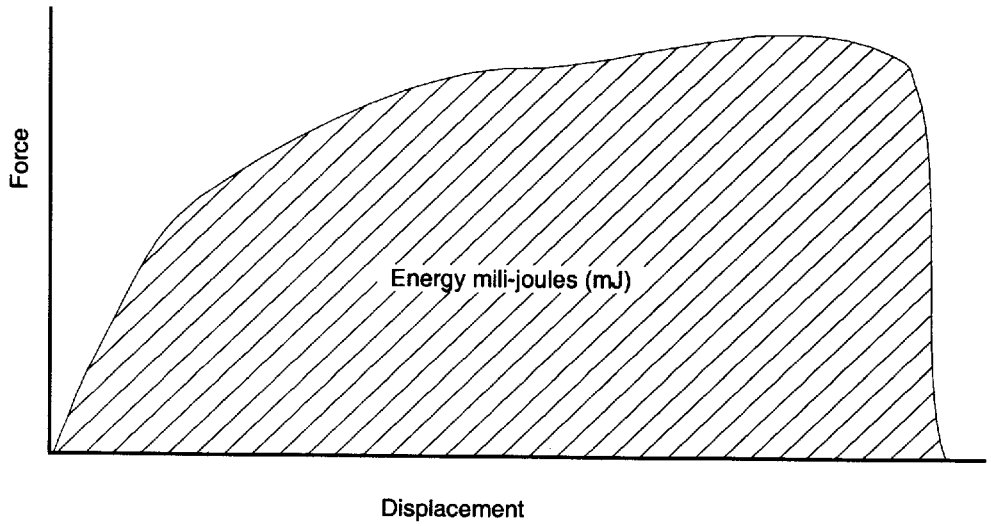
FIG. 5b Example of a plot of force versus displacement

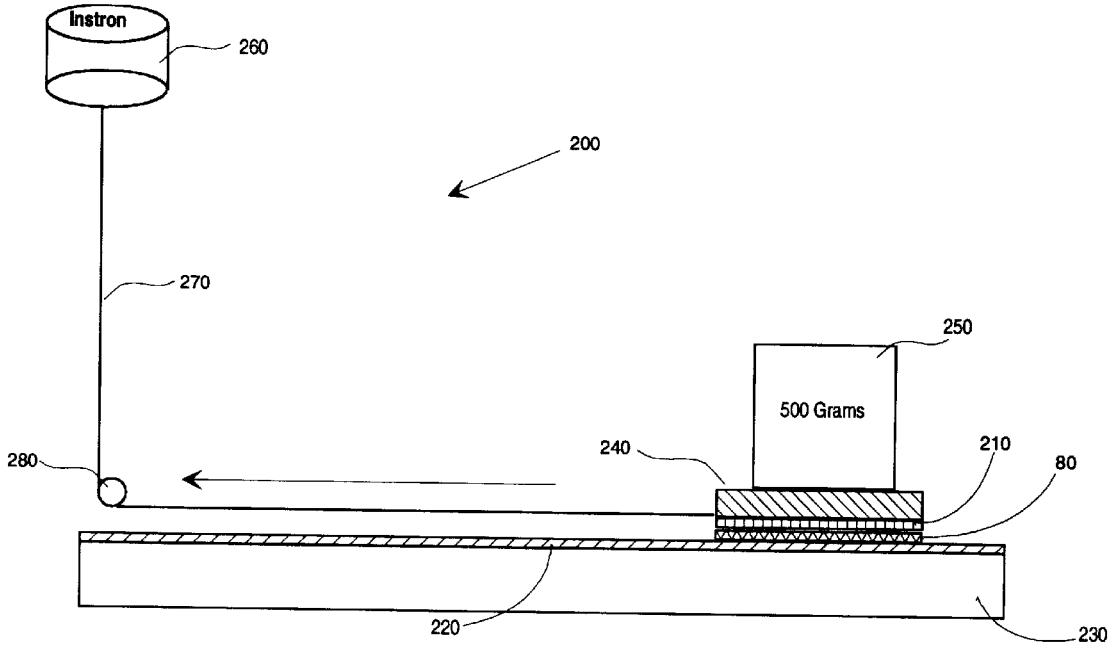
FIG. 6a Wet drag testing method
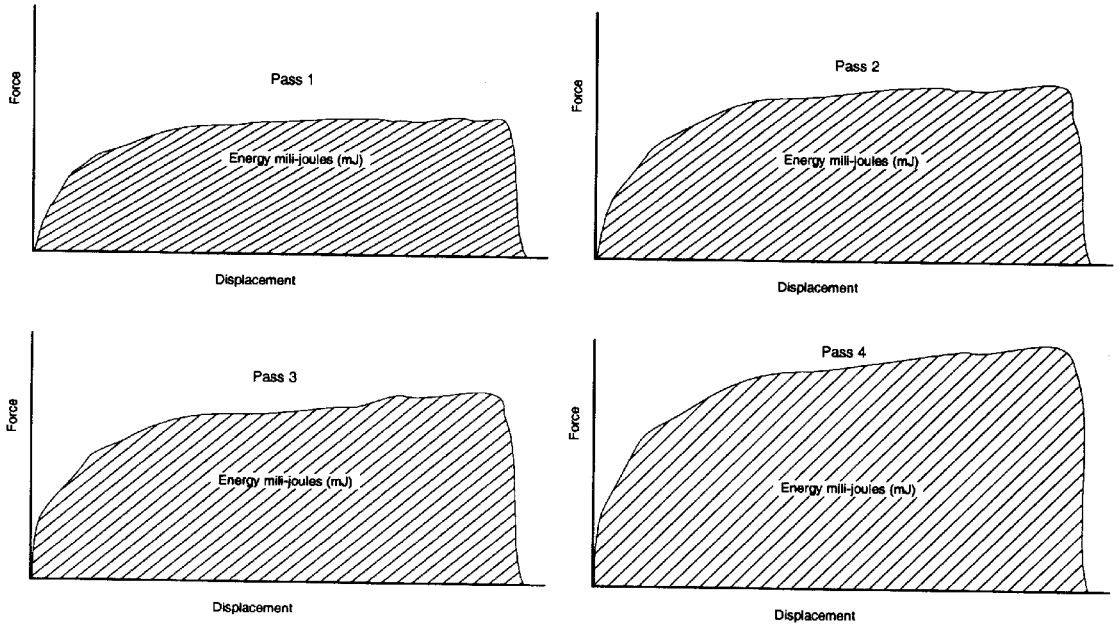
FIG. 6b Example of a plot of force versus displacement – 4 passes

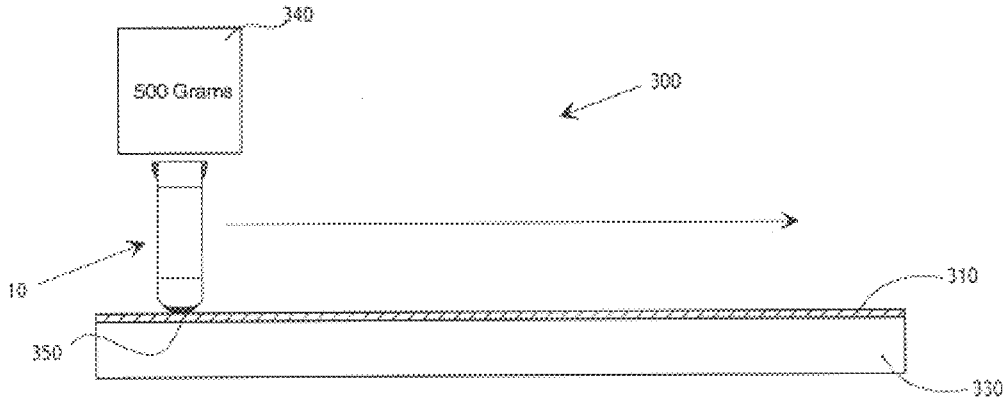
FIG. 7a Elevational View of the test method for measuring Product Spread.
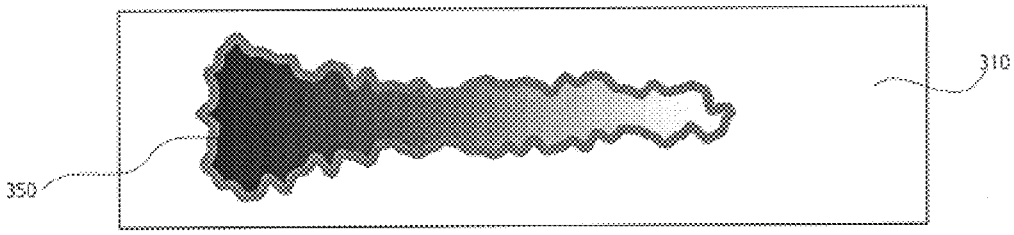
FIG. 7b Top view of the material (310) in Fig.7a after a Spread Test has been completed
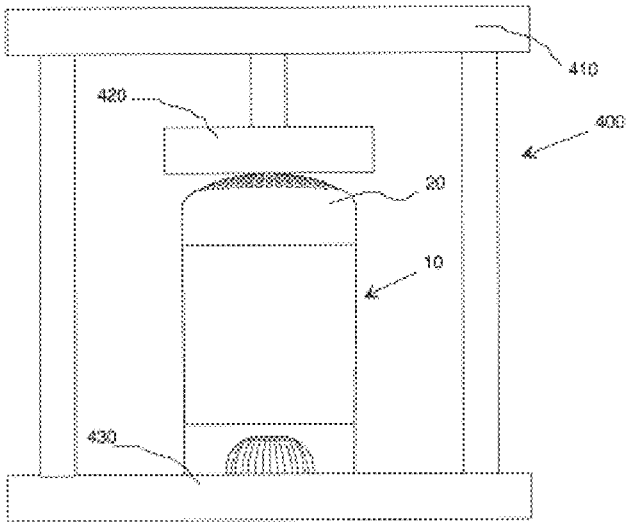
Fig. 8 elevational sectional view of an example of the Outward Deflection test method

SOFT APPLICATOR DOME

CROSS REFERENCE TO RELATED APPLICATION

This application claims the benefit of U.S. Provisional Application No. 60/199,414, filed Apr. 24, 2000.

FIELD OF INVENTION

The present invention relates to improved product dispensers. More particularly, the present inventions relates to an improved dispenser having an applicator dome constructed to include a thermoplastic elastomer.

BACKGROUND

Multi-use rub-on antiperspirant and deodorant (APDO) products are currently marketed in a multi-use canister with a means to dispense the product through an applicator affixed to the top of the canister. The applicator is typically shaped in a way so as to fit the contours of the underarm, and is commonly molded using a polypropylene (PP), polyethylene (PE), polyester (PET), polyvinylchloride (PVC) or similar thermoplastic material. These current applicator designs are known to have in-use disadvantages such as (a) insufficient product spreading, (b) being too hard thus irritating to rub in the underarm, and (c) being too loud thus giving the consumer the perception of irritation. One approach to solving these problems is to formulate the product to be less viscous, such as a cream or gel. However, these product-applicator combinations generally feel too slimy to the consumer during product application.

It is, therefore, desirable to provide a product applicator which provides sufficient product spreading with use of a softer applicator dome while not feeling too slimy to the consumer during product application.

SUMMARY OF THE INVENTION

In an exemplary embodiment of the invention, an applicator being constructed to include a thermoplastic elastomer. In another embodiment, an applicator dome has a first material and a second material, wherein, the first material is made of a thermoplastic elastomer and the second material is made of a material having more rigidity than the first material. The second material provides structural support for the first material. In yet another embodiment, an applicator dome has a first material and a second material, wherein, the first material has a Dimethicone Droplet Spread Rate value from about 200 $mm^2$ to about 900 $mm^2$. In yet another embodiment, an applicator dome has an inward-deflection value of at least 0.17 mm. This embodiment may also include an outward-deflection value ranging from 0.000 mm to about 0.40 mm. In yet another embodiment, an applicator dome has a wet-drag value ranging from about 300 mJ to about 600 mJ. In yet another embodiment, an applicator dome has a dry-drag value ranging from about 500 mJ to about 3000 mJ. In yet another embodiment, an applicator dome has an increase in wet-drag value of at least 150 mJ after four product application strokes onto an application surface.

Other advantages and novel features of the present invention will become apparent to those skilled in the art from the following detailed description, which simply illustrates various modes contemplated for carrying out the invention. As will be realized, the invention is capable of other different obvious aspects, all without departing from the invention. Accordingly, the drawings and descriptions are illustrative in nature and not restrictive.

BRIEF DESCRIPTION OF THE DRAWINGS

While the specification concludes with claims particularly pointing out and distinctly claiming the present invention it is believed that the same will be better understood from the following description, taken in conjunction with the accompanying drawings, in which:

FIG. 5*a* is an elevational view of an example of a dry-drag test method;

FIG. 5*b* is an example of a data plot of force versus displacement;

FIG. 6*a* is an elevational view of an example of a wet-drag test method;

FIG. 6*b* is an example of a set of four data plots of force versus displacement;

FIG. 7*a* is an elevational view of an example of a test method for measuring product spread;

FIG. 7*b* is a top view of the material in FIG. 7*a* after a spread test has been completed;

FIG. 8 is an elevational view of an example of a test method for measuring inward deflection of an applicator dome using an Instron.

DETAILED DESCRIPTION OF EXEMPLARY EMBODIMENTS

Reference will now be made in detail to various exemplary embodiments of the invention, several of which are also illustrated in the accompanying drawings, wherein like numerals indicate the same elements throughout the views, and numbers with the same final two digits indicate corresponding elements among embodiments.

Figure 1:
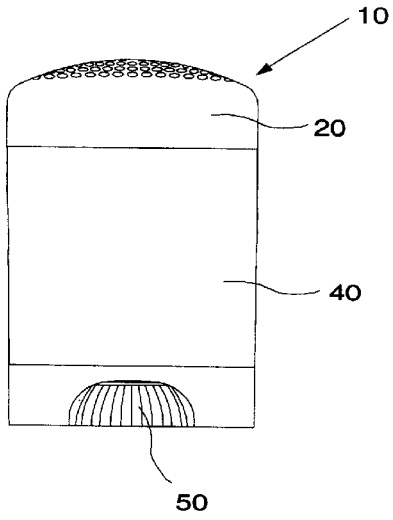
FIG. 1 is an elevational view of an assembled screw driven applicator with a perforated applicator dome.
Figure 2:
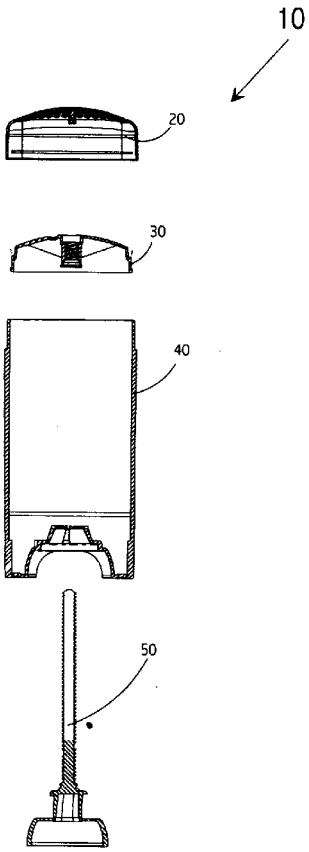
FIG. 2 is an exploded sectional view of the screw driven applicator in FIG. 1.

With reference to FIGS. 1 and 2, applicator 10 is disclosed. Applicator 10 is a screw dispensing package commonly used in applying deodorant and other materials. Applicator 10 employs a screw mechanism hand wheel 50 to move an elevator 30 within a container body 40 which pushes product 80 from the container body 40 through the applicator dome 20.

Figure 3:
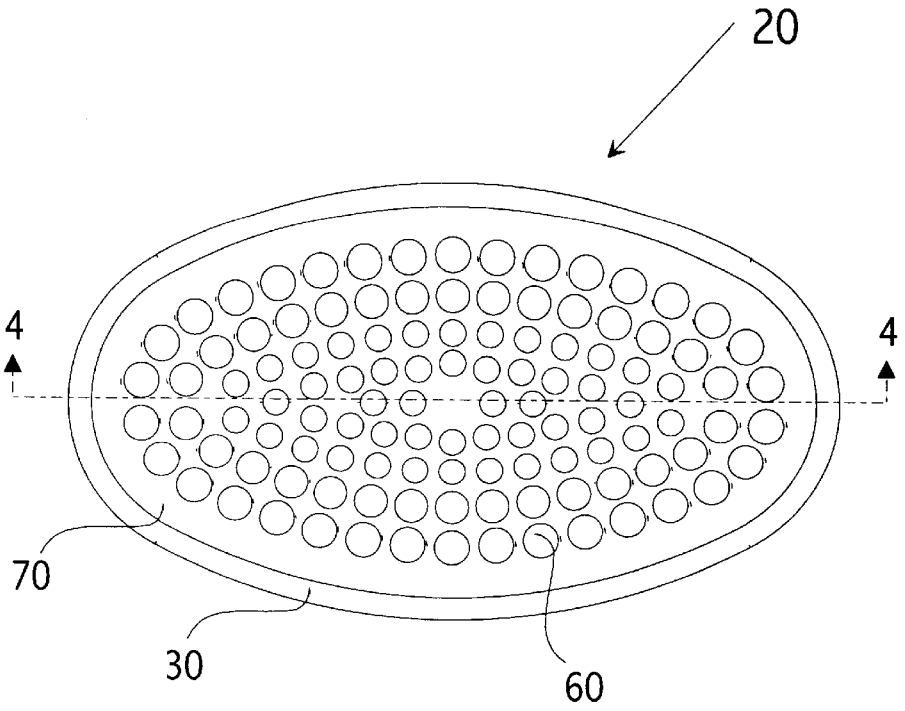
FIG. 3 is a top view of the perforated applicator dome being constructed of a first and second material.
Figure 4:
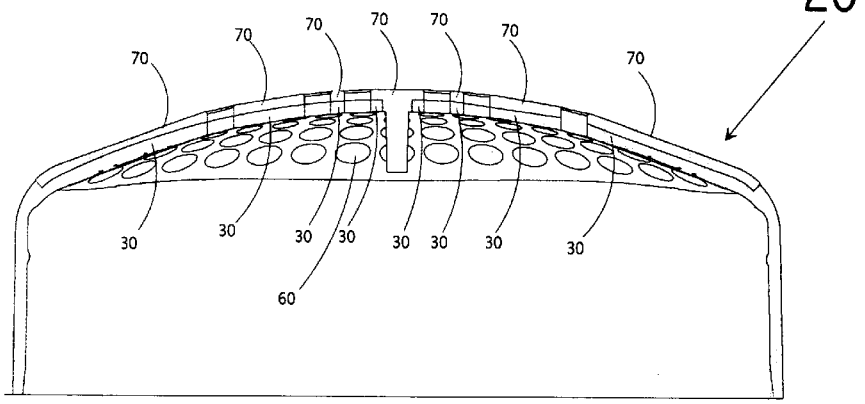
FIG. 4 is a cross-sectional view of the perforated applicator dome in FIG. 3.

With reference to FIGS. 3 and 4, an applicator dome with soft material application surface is disclosed. The applicator dome 20 is perforated with apertures 60 to allow the passage of product 80. Applicator base material 30 provides support and a means of attachment for soft applicator surface 70. Base material 30 and soft applicator surface 70 may be joined using known connection means, including but not limited to, co-injection molding, insert molding, and adhesion.

In a first approach to increase spreading of product 80, a soft material 70 having increased drag properties is added to applicator dome 20. Drag is defined as the amount of energy required to move a flat plaque of material across a surface under a fixed force exerted normal to the application surface. Thus, drag is the result of both frictional and mechanical resistance to lateral movement across the surface. There are two types of drag discussed herein, dry-drag and wet-drag. Dry-drag is measured without any product applied to the plaque. Wet-drag is measured with product applied to the plaque.

FIG. 5*a* depicts a dry-drag test method 100 used to quantify the energy necessary to drag a plaque 110 of a soft material 70 across a skin-like substrate 120 (for example, boltaflex vinyl which may be purchased from Irvin & Alan Company). In this dry-drag test method 100, the skin-like substrate 120 is cut into a rectangular shape having dimensions of about 10 inches long and about 3 inches wide. The skin-like substrate 120 is adhered to a supporting horizontal planer surface 130 using double-faced adhesive tape (not shown). A plaque 110 of soft material 70 is cut into a rectangular shape having dimensions of about 2 inches long and about 0.75 inches wide and from about 0.125 to about 0.3 inches thick. Plaque 110 is attached to a sled 140 using double-faced adhesive tape (not shown). Sled 140 with attached plaque 110 is placed at the far end of the skin-like substrate 120. Sled 140 is then loaded with a 500-gram weight 150. A vertically oriented Instron 160 (or any similar load cell device having the capabilities of controlled motion, force measurement, and data acquisition) is attached to the sled 140 using a string 170 routed 90 degrees over a pulley 180. Remove any slack from string 170, initialize Instron 160 and set the traverse speed to 50 inches per minute. Sled 140 is then pulled a distance of approximately 6 inches. A force versus displacement plot is then produced, example in FIG. 5*b*. From this plot, the energy necessary to drag plaque 110 of soft material 70 across skin-like substrate 120 is calculated. The chart below shows the results of testing two different types of materials (conventional materials versus thermoplastic elastomers [TPE]) using dry-drag test method 100. Each material was tested four times and then their average result was calculated. Under "conventional materials", polypropylene (PP), high density polyethylene (HDPE), and polyester (PET) were selected because they are commonly used in manufacturing of applicator dames 20. "Thermoplastic elastomers" is not limited only those listed below, in fact, other suitable materials will be discussed later. In an unlimiting, exemplary embodiment of the present invention an applicator dome has a dry-drag value ranging from about 500 mJ to about 3000 mJ.

| | Dry Drag Data energy reported in (mJ) | | | | |
|---|---|---|---|---|---|
| | Pass 1 | Pass 2 | Pass 3 | Pass 4 | Average |
| Conventional Materials | | | | | |
| Polypropylene-Dow H700 12NA | 305 | 288 | 284 | 280 | 289 |
| High density polyethylene-Petrothene LS 3150-00 | 270 | 222 | 215 | 211 | 230 |
| Polyester-Eastman EN058 | 347 | 336 | 334 | 349 | 342 |
| Thermoplastic Elastomers | | | | | |
| Kraton G2706 (GLS Corporation) | 984 | 992 | 1006 | 1059 | 1010 |

-continued

| | Dry Drag Data energy reported in (mJ) | | | | |
|---|---|---|---|---|---|
| | Pass 1 | Pass 2 | Pass 3 | Pass 4 | Average |
| Kraton G6730 (GLS Corporation) | 1127 | 1165 | 1184 | 1156 | 1158 |
| Kraton G7930 (GLS Corporation) | 1096 | 1058 | 1077 | 1075 | 1077 |
| Santoprene 8211-35 (Advanced Elastomer Systems) | 1216 | 1181 | 1178 | 1157 | 1183 |
| Santoprene 9271-55 (Advanced Elastomer Systems) | 795 | 793 | 771 | 800 | 790 |
| Santoprene 9911-35 (Advanced Elastomer Systems) | 1147 | 1094 | 1126 | 1131 | 1125 |

Figure 10:
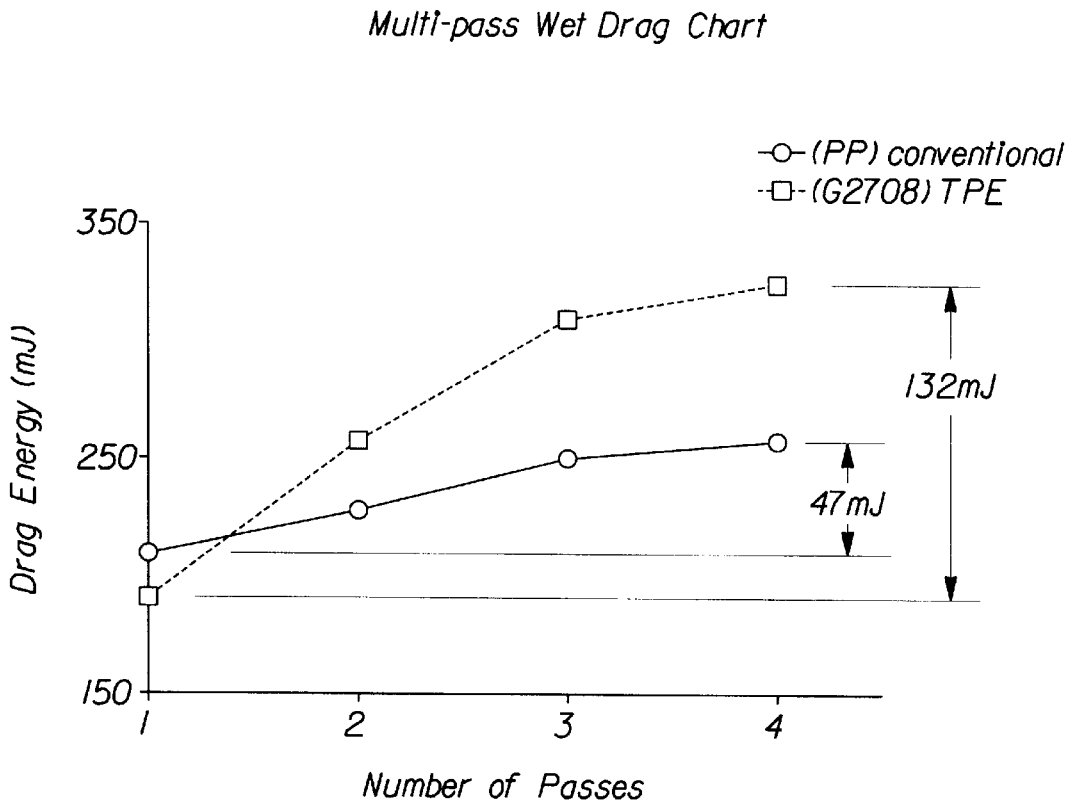
FIG. 10 is a graph demonstrating the increase in drag energy for two separate comparisons.

FIG. 6*a* depicts a wet-drag test method 200 used to quantify the energy necessary to drag a plaque 210 of a soft material 70 across a skin-like substrate 220 (for example, boltaflex vinyl which may be purchased from Irvin & Alan Company). In this wet-drag test method 200, the skin-like substrate 220 is cut into a rectangular shape having dimensions of about 10 inches long and about 3 inches wide. The skin-like substrate 220 is adhered to a supporting horizontal planer surface 230 using double-faced adhesive tape (not shown). A plaque 210 of soft material 70 is cut into a rectangular shape having dimensions of about 2 inches long and about 0.75 inches wide and from about 0.125 to about 0.3 inches thick. Plaque 210 is attached to a sled 240 using double-faced adhesive tape (not shown). Approximately 0.4 grams of product 80 is uniformly coated onto the bottom surface of plaque 210. Sled 240 with attached plaque 210 and product 80 is placed at the far end of the skin-like substrate 220. Sled 240 is then loaded with a 500-gram weight 250. A vertically oriented Instron 260 (or any similar load cell device having the capabilities of controlled motion, force measurement, and data acquisition) is attached to the sled 240 using a string 270 routed 90 degrees over a pulley 280. Remove any slack from string 270, initialize Instron 260 and set the traverse speed to 50 inches per minute. Sled 240 is then pulled a distance of approximately 6 inches. A force versus displacement plot is then produced, example in FIG. 6*b* entitled "Pass 1". From this plot, the energy necessary to drag plaque 210 of soft material 70 across skin-like substrate 220 is calculated. To replicate the consumer experience of applying product 80 (e.g. antiperspirant or deodorant to the underarm), four passes (i.e., strokes) were conducted and their respective data acquired as exampled in FIG. 6*b*. The chart below shows the results of testing polypropylene (PP) and Kraton G2706 (available from the GLS Corporation). Although these two materials were chosen for further testing purposes, it is believed that other conventional and thermoplastic elastomers would perform similarly (See FIG. 10).

| Multi-pass Drag Energy (mJ) | | | |
|---|---|---|---|
| | Conventional Polypropylene (Dow H700 12NA) | TPE Kraton G2706 (GLS Corporation) | |
| Pass 1 | 210 | 190 | |
| Pass 2 | 228 | 258 | |
| Pass 3 | 248 | 309 | |
| Pass 4 | 257 | 322 | |
| Average | 236 | 270 | |
| Energy Delta (4-1) | 47 | 132 | |
| Total Energy | 943 | 1079 | ←14% increase |

This graph further demonstrates the increase in drag energy for two separate comparisons. First, for the TPE material itself, the drag energy is substantially increased after each pass (i.e. pass 4>>pass 3>>pass 2>>pass 1). In fact, in the experiment described above, the difference between the drag energy between pass 4 and pass 1 equals 132 mJ, which is almost equal to an additional stroke. Without wishing to be bound by theory, it is believed that this phenomenon occurs because the TPE's wet-drag value (190 mJ) is moving closer to the much higher dry-drag value (1010 mJ) as compared to the slight increase in polypropylene which has a wet-drag value of 210 mJ and a dry-drag value of 289 mJ. As such, an applicator dome 20 made with WE will exert more drag energy (and subsequently more shear to spread the product 80) after each stroke, while the first stroke is smooth and the later strokes are rougher however lubricated. Secondly, the TPE material exerts more total drag energy (1079 mJ) than the polypropylene (943 mJ), an increase of 14%. Therefore, an applicator dome 20 made with TPE will provide better shearing and spreading than an applicator made with conventional materials. In an unlimiting, exemplary embodiment of the present invention an applicator dome has an increase in wet-drag value of at least 150 mJ after four product application strokes onto an application surface.

In another approach to increase spreading of product 80, a soft material 70 having increased Dimethicone Droplet Spread Rate (DDSR) properties for hydrophobic product ingredients (e.g. cyclomethicone, cyclopentasiloxane, cyclohexasiloxane, volatile and non-volitile isoparaffins, volatile and non-volatile dimethicone ranging in viscosity from 0.65 centistokes to about 12000 centistokes, mineral oil, or other similar hydrophobic materials) is added to applicator dome 20. DDSR is a measure of the rate a drop of dimethicone spreads on a flat surface of a material. The test method for calculating DDSR begins with dropping a single droplet of dimethicone onto a flat sheet of the material. The droplet should be created by using a syringe fitted with a Monoject 250 hypodermic needle (20GA×1 inch; having a squared-off tip accomplished by sanding) and dropped on the material from a height of about 2 inches. Then after waiting 75 seconds, estimate the approximate area of the puddle formed by the droplet by measuring the puddle's width and length. DDSR is the area of the puddle in square millimeters ($mm^2$). The chart below shows the results of testing conventional materials and TPE materials.

| Dimethicone Droplet Spread Rate (DDSR) (using Dow Corning 200 Fluid 10 cSt Dimethicone) | ($mm^2$) |
|---|---|
| Conventional | |
| Polypropylene-Dow H700 12NA | 79 |
| High density polyethylene-Petrothene LS 3150-00 | 95 |
| Polyester-Eastman EN058 | 113 |
| Thermoplastic Elastomers | |
| Kraton G2706 (GLS Corporation) | 319 |
| Kraton G6730 (GLS Corporation) | 398 |
| Kraton G7930 (GLS Corporation) | 325 |
| Santoprene 8211-35 (Advanced Elastomer Systems) | 314 |
| Santoprene 9271-55 (Advanced Elastomer Systems) | 330 |
| Santoprene 9911-35 (Advanced Elastomer Systems) | 404 |

An increase in DDSR results in an increase in the efficiency of spreading of hydrophobic product ingredients (e.g. antiperspirant or deodorant). The increased DDSR indicates an increased attractive force between the material (e.g. TPE) and the hydrophobic product ingredients. These attractive forces act to retain the product on the material. If this material is added to an applicator dome 20, then the product would remain on the applicator dome 20 longer during product application which would result in improved spreading of the product. As such, one preferred embodiment for an applicator dome may comprise of at least one material having a Dimethicone Droplet Spread Rate value from about 200 $mm^2$ to about 900 $mm^2$, more preferably from about 250 $mm^2$ to about 500 $mm^2$.

FIGS. 7*a* and 7*b* depicts a method 300 for measuring product spread. First, a skin-like substrate 310 (for example, boltaflex vinyl which may be purchased from Irvin & Alan Company) is adhered to the top surface of a one-inch thick polyurethane foam pad 330. Next, a single-dose of product (about 0.25 gram) from the applicator 10 is dispensed and applied to the skin-like substrate 310 during a 10-inch stroke under a 500-gram load 340. Then, using a computer (e.g., Deskscan II version 2 and BioScan Optimas version 4.10 software) and an optical scanner, the skin-like substrate 310 having spread product 350 is scanned to determine the coverage area of spread product 350. The following spread test data was obtained using product spread test method 300 and Secret® Platinum® brand antiperspirant:

| Product Spread using Secret ® Platinum ® | ($in^2$) |
|---|---|
| Conventional | |
| (a) Polypropylene-Dow H700 12NA-0.035" thick PP mesh dome | 7.00 |
| Thermoplastic Elastomers | |
| (b) Kraton G2706 (GLS Corporation)-over 0.035" thick PP mesh dome | 7.70 (10% increase) |

**Note: Row (b) is significantly different than row (a) to a 90% confidence level.

This product spread data shows that a TPE material with a DDSR of 319 provides 10% more product coverage than a conventional applicator material (polypropylene) with a DDSR of 79.

In yet another approach to increase spreading of product 80, a soft material 70 having a decreased durometer value is added to applicator dome 20. Durometer is a measure of hardness. The durometer value (also known as Shore A hardness value) is often supplied by the manufacturer or may be tested by commonly used test methods (e.g., ASTM D2240-97). The table below provides the durometer value for both conventional and TPE materials.

| Durometer | |
|---|---|
| Conventional | |
| Polypropylene-Dow H700 12NA | >100 |
| High density polyethylene-Petrothene LS 3150-00 | >100 |
| Polyester-Eastman EN058 | >100 |
| Thermoplastic Elastomers | |
| Kraton G2706 (GLS Corporation) | 28 |
| Kraton G6730 (GLS Corporation) | 30 |
| Kraton G7930 (GLS Corporation) | 30 |
| Santoprene 8211-35 (Advanced Elastomer Systems) | 35 |
| Santoprene 9271-55 (Advanced Elastomer Systems) | 55 |
| Santoprene 9911-35 (Advanced Elastomer Systems) | 35 |

If applicator dome 20 is made using a material having a lower durometer value, then the inward deflection is increased. Inward deflection is measured by the distance that the applicator dome 20 travels inwardly when an outward force is applied to it. FIG. 8 shows an example of a test method 400 for calculating inward deflection. Applicator 10 is placed inside of Instron 410 (e.g., model 8511), more specifically, between moving top plate 420 and stationary bottom plate 430. As top plate 420 travels downward at a rate of about 0.0125 in/sec, it exerts force onto applicator dome 20. The applied force and resulting inward deflection are electronically acquired. The amount of inward deflection at a 500-gram load is reported below.

| Inward Deflection at a 500-gram load | (mm) |
|---|---|
| Conventional | |
| Secret (PP) | 0.16 |
| Lever Ultra Dry (HDPE) | 0.07 |
| Gillette Clear (PET) | 0.07 |
| Mennen Speed Stick (PET) | 0.08 |
| Thermoplastic Elastomers | |
| Kraton G2706 (GLS Corporation) over 0.035" thick PP mesh dome | 0.20 |
| Kraton G2706 (GLS Corporation) over 0.030" thick PP mesh dome | 0.37 |
| Kraton G6730 (GLS Corporation) over 0.035" thick PP mesh dome | 0.17 |
| Kraton G7930 (GLS Corporation) over 0.035" thick PP mesh dome | 0.21 |
| Santoprene 8211-35 (Advanced Elastomer Systems) | 0.19 |

If applicator dome 20 is made using a material having a lower durometer value which results in an increased inward deflection, then product spreading will be increased. To illustrate this phenomenon, two samples having the same type of material (i.e., Kraton G2607) but having different underlining support (i.e., 0.035 inch thick PP mesh dome versus 0.030 inch thick PP mesh dome mesh) were tested using the product test method in FIGS. 7*a* and 7*b*

| Product Spread using Secret ® Platinum ® | ($in^2$) |
|---|---|
| Thermoplastic Elastomers | |
| (a) Kraton G2706 (GLS Corporation) over 0.035" thick PP mesh dome | 7.7 |
| (b) Kraton G2706 (GLS Corporation) over 0.030" thick PP mesh dome | 9.5 (23% increase) |

** Note: Row (b) is significantly different than row (a) to a 90% confidence level.

Figure 9:
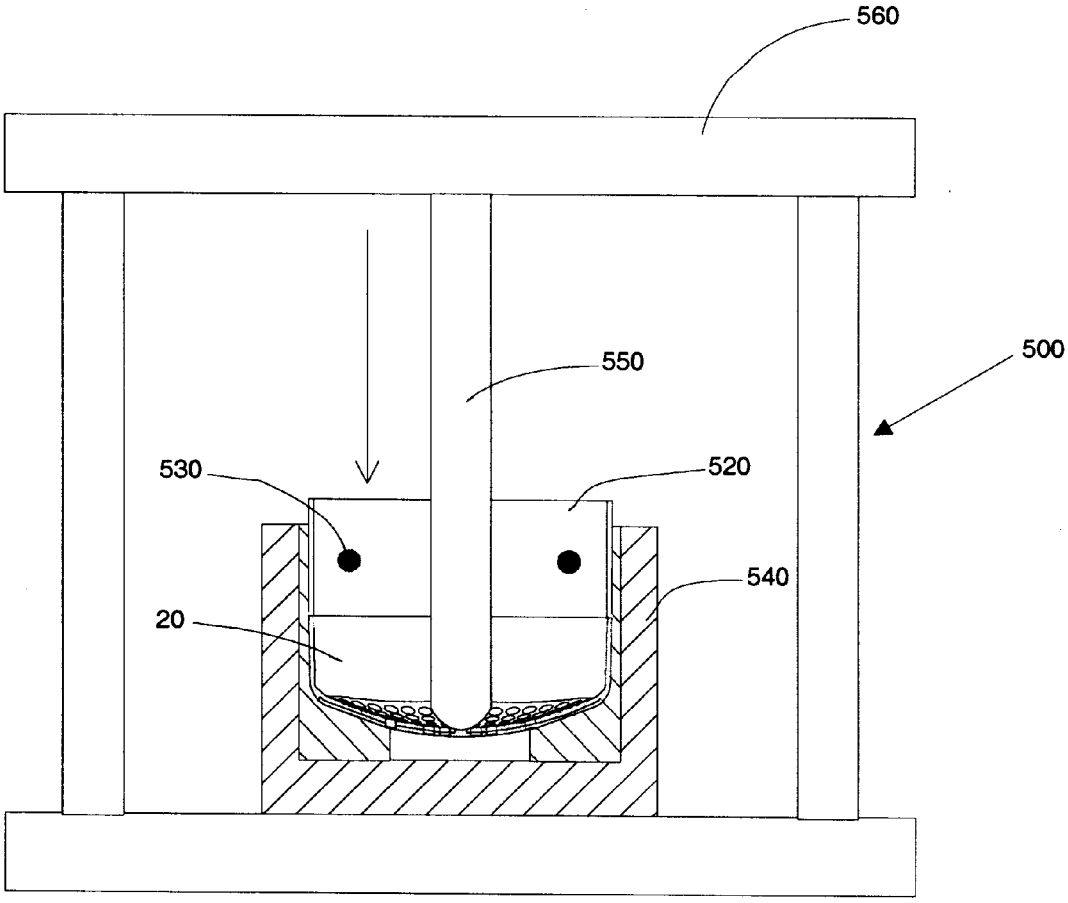
FIG. 9 is an elevational view of an example of a test method for measuring outward deflection of an applicator dome using an Instron.

While increased inward deflection is desirable to improve product spread, applicator dome 20 must still be sufficiently rigid to minimize outward deflection to prevent product weeping. Outward deflection is measured as the distance that the applicator dome 20 travels when an inward force is applied to it. FIG. 9 shows an elevated sectional view of an example of a test method 500 for measuring outward deflection. The bottom portion of the container body 520 of an empty product package is cut away to expose the underside of the applicator dome 20. Two dowel pins 530 slide through holes drilled in the side of the container body 520. These dowel pins support the applicator dome 20 in an upside-down position on the test apparatus 540. A rod 550 attached to the Instron 560 travels downward at a rate of about 0.0125 in/sec, it exerts a force to the inside wall of the applicator dome 20. The applied force and resulting outward deflection are electronically acquired. The amount of outward deflection at a 500-gram load is reported below. In an unlimiting, exemplary embodiment of the present invention an applicator dome has an outward-deflection value ranging from 0.000 mm to about 0.40 mm.

| Outward Deflection at a 500-gram load | (mm) |
|---|---|
| Conventional | |
| Secret (PP) | 0.19 |
| Lever Ultra Dry (HDPE) | 0.10 |
| Gillette Clear (PET) | 0.06 |
| Mennen Speed Stick (PET) | 0.08 |
| Thermoplastic Elastomers | |
| Kraton G2706 (GLS Corporation) over 0.035" thick PP mesh dome | 0.18 |
| Kraton G2706 (GLS Corporation) over 0.030" thick PP mesh dome | 0.25 |

Product weeping is defined as the separation of a fluid product component from an APDO product resulting from a stress applied to the APDO product. If applicator dome 20 has a high outward deflection, then the stress imparted into the applicator dome 20 would be rebounded onto the product resulting in product weeping. As such, until recently, it has been believed that an antiperspirant/deodorant (APDO) applicator dome 20 should be molded entirely of hard, rigid thermoplastic materials such as PP, PE, PET, PVC, and similar materials.

To overcome the competing interests of desirable inward deflection and undesirable outward deflection, it has been discovered that an applicator dome 20 may be constructed with a stiffer material underneath (e.g., polypropylene) a layer of TPE, as exampled in FIG. 4. This embodiment provides sufficient inward deflection for improved product spreading while minimizing outward deflection to minimize product weeping.

To further demonstrate the benefits of improved spreading from applicator domes 20 having TPE, the following chart shows that improved spreading leads to a decreased amount of product residue after 4 hours from application as measured by expert panelists.

| | Expert Panel Results Scale 1–7 (1 = best: 7 = worst) | |
|---|---|---|
| | PP (Conventional Material) (a) | TPE (G2706) Applicator (b) |
| Product Residue @ 4 hours | 1.74 | 1.35 a |

** Note: Column (b) is significantly different than column (a) to a 95% confidence level.

Until recently, it was believed that consumers preferred an applicator with APDO products to have a wet-drag level in the range from about 100 mJ to about 300 mJ. As such, applicators currently marketed with APDO products typically have a wet-drag level within the range of 100 mJ to 300 mJ. Thus, the range of wet-drag level from 100 mJ to 300 mJ is defined as the old-acceptable range.

Average Drag Energy (mJ) with a variety of antiperspirant products

| Conventional | Secret Platinum | Degree Ultra Dry | Speed Stick Gel | Gillette Clear Gel |
|---|---|---|---|---|
| Polypropylene-Dow H700 12NA | 236 | 272 | 191 | 195 |
| High density polyethylene-Petrothene LS 3150-00 | 172 | 281 | 181 | 137 |
| Polyester-Eastman EN058 | 157 | 195 | 125 | 126 |

However, it has been discovered that increasing the wet-drag level to a range from about 300 mJ to about 600 mJ provides improved application feel. The discovery, that had previously not been appreciated, is that when the wet-drag level is too low, such as less than about 300 mJ, consumers perceive the product to be too slimy during application. Furthermore, when the wet-drag level is too high, such as above about 600 mJ, the applicator is irritating to the underarm during application. Thus, a new consumer preferred range of wet-drag for an APDO product ranges from about 300 mJ to about 600 mJ.

Average Drag Energy (mJ) with a variety of antiperspirant products

| Thermoplastic Elastomers | Secret Platinum | Degree Ultra Dry | Speed Stick Gel | Gillette Clear Gel |
|---|---|---|---|---|
| Kraton G2706 (GLS Corporation) | 270 | 350 | 397 | 331 |
| Kraton G6730 (GLS Corporation) | 378 | 356 | 282 | 424 |
| Kraton G7930 (GLS Corporation) | 357 | 364 | 268 | 332 |
| Santoprene 8211-35 (Advanced Elastomer Systems) | 259 | 309 | 260 | 259 |
| Santoprene 9271-55 (Advanced Elastomer Systems) | 238 | 266 | 268 | 207 |
| Santoprene 9911-35 (Advanced Elastomer Systems) | 226 | 269 | 208 | 353 |

Figure 11:
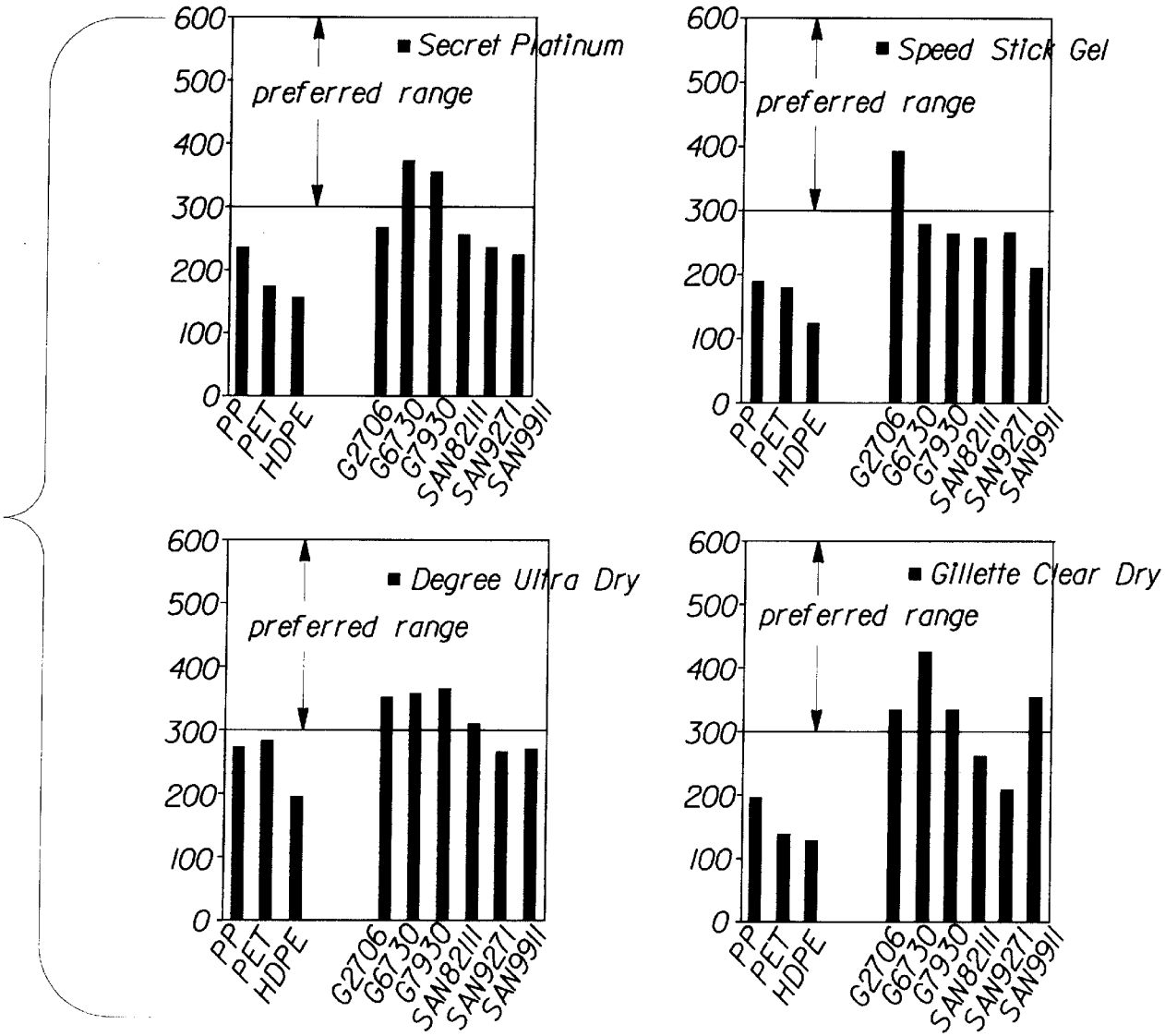
FIG. 11 depicts graphs showing wet drag values of conventional applicator domes and TPE domes.

Having just discovered a new consumer preferred range of wet-drag for an APDO product ranges from about 300 mJ to about 600 mJ, it can be further appreciated via the graphs shown in FIG. 11 that an applicator-product wet-drag value may be increased into the new preferred range by merely change from a conventional applicator dome to a TPE dome without having to reformulate the product (e.g., Secret Platinum with G6730 and G7930, Speed Stick Gel with G2706, etc.). This technique is possible after having discovered the unexpected reduction in dry-drag value and preferred resulting wet-drag value of TPE applicators.

In addition to the benefits of improved product spreading and better consumer feel, the use of TPE materials for applicator domes decreases the level of audible noise. Without wishing to be bound by theory, it is discovered and believed that the TPE material provides dampening of noise and shock absorption which results in a lower level of audible noise. The consumer associates such audible noise with irritation of the skin. Accordingly, it is beneficial to minimize the level of audible noise.

A decibel meter (Quest Technologies—model 2900) was used in a consumer study to measure the noise generated from applicators being rubbed against women's leg razor stubble (similar to underarm razor stubble, however, less offensive to examine). The women were told not to shave their legs for 1 to 2 days before conducting this test. The lower leg of each participant was tested.

Audible noise during application

| | Decibel level |
|---|---|
| Conventional Polypropylene-Dow H700 12NA | 31.8 dB |
| Thermoplastic Elastomers Kraton G2706 (GLS Corporation) | 24.3 dB* |

*24.3 equals the background noise in the test facility. The sound generated from the TPE applicator dome was insufficient to be measured above the background noise in the test facility.

Audible noise of various locations

| | Decibel level |
|---|---|
| Bathroom Background Noise | 20–30 dB |
| Toilet Flush | 70–80 dB |
| Faucet Running Water | 60–70 dB |
| Hair Dyer | 70–80 dB |
| Bathroom Exhaust Fan | 55–70 dB |

Having shown and described various embodiments of the present invention, further adaptations of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the inventive system have been discussed for illustrative purposes, it should be understood that the elements described may be constantly updated and improved by technological advances. In yet another example, it should be noted that the term "thermoplastic elastomers" as used herein is intended include all suitable materials having a Shore A hardness ranging from Shore A 3 to Shore A 95 selected from the groups of thermoplastic elastomers, thermoplastic vulcanizates, thermosetting or vulcanized elastomers, ethylene copolymers and terpolymers, propylene copolymers and terpolymers, closed or open cell polymeric foam, and mixtures or compounds thereof. More specifically:

Suitable thermoplastic elastomers include, but are not limited to: a) styrene-isoprene-styrene triblock coplymers such as the Kraton D series from Shell; b) styrene-butadiene-styrene triblock coplymers such as the Kraton D series from Shell; c) styrene-saturated olefin-styrene triblock coplymers such as the Kraton G series from Shell; d) thermoplastic rubber compounds such as the Dynaflex series from GLS Corporation; e) ethylene propylene elastomers; f) polyester-polyether multiblock copolymers such as the Hytrel Series from DuPont; g) polyamide-polyether multiblock copolymers such as the Pebax series from Atochem; and h) polyurethane elastomers such as the Estane family from BF Goodrich.

Suitable thermoplastic vulcanizates include, but are not limited to: Santoprene series from Advanced Elastomers.

Suitable thermosetting or vulcanized elastomers include, but are not limited to: a) polyisoprene rubber; b) polybutadiene; c) styrene butadiene; d) nitrile; e) chloropene" (=Neoprene=chloroisoprene); f) butyl; and g) ethylene-propylene diene monomer (EPDM).

Suitable ethylene copolymers include, but are not limited to: a) ethylene vinylacetate; b) ethylene methyl acrylate; c) ethylene ethyl acrylate; d) ethylene butene; e) ethylene hexene; f) ethylene octene; and g) ethylene propylene in which the mole % ethylene is >50%.

Suitable propylene copolymers include, but are not limited to: ethylene propylene in which the mole % ethylene is <50%.

Accordingly, the scope of the present invention should be considered in terms of the following claims and is understood not to be limited to the details shown and described in the specification and drawings.

What is claimed is:

1. An antiperspirant/deodorant applicator dome having an application surface constructed to include a thermoplastic elastomer, wherein said thermoplastic elastomer provides increasing shear of an applied antiperspirant/deodorant product over multiple passes of said applicator dome to an underarm of a consumer, wherein said thermoplastic elastomer has a Dimethicone Droplet Spread Rate value from about 200 $mm^2$ to about 900 $mm^2$.

2. The applicator dome according to claim 1 wherein said Dimethicone Droplet Spread Rate value is from about 250 $mm^2$ to about 500 $mm^2$.

3. An antiperspirant/deodorant applicator dome having an application surface constructed to include a thermoplastic elastomer, wherein said thermoplastic elastomer provides increasing shear of an applied antiperspirant/deodorant product over multiple passes of said applicator dome to an underarm of a consumer wherein said applicator dome has an inward-deflection value of at least 0.17 mm using a 500 gram load.

4. The applicator dome according to claim 3 wherein said applicator dome has an outward-deflection value ranging from 0.000 mm to about 0.40 mm using a 500 gram load.

5. An antiperspirant/deodorant applicator dome having an application surface constructed to include a thermoplastic elastomer, wherein said thermoplastic elastomer provides increasing shear of an applied antiperspirant/deodorant product over multiple passes of said applicator dome to an underarm of a consumer, wherein said applicator dome has a wet-drag value ranging from about 300 mJ to about 600 mJ using a 500 gram load.

6. An antiperspirant/deodorant applicator dome having an application surface constructed to include a thermoplastic elastomer, wherein said thermoplastic elastomer provides increasing shear of an applied antiperspirant/deodorant product over multiple passes of said applicator dome to an underarm of a consumer, wherein said applicator dome has a dry-drag value ranging from about 500 mJ to about 3000 mJ using a 500 gram load.

7. An antiperspirant/deodorant applicator dome having an application surface constructed to include a thermoplastic elastomer, wherein said thermoplastic elastomer provides increasing shear of an applied antiperspirant/deodorant product over multiple passes of said applicator dome to an underarm of a consumer, wherein said applicator dome has an increase in wet-drag value of at least 150 mJ after four product application strokes onto an application surface using a 500 gram load.

* * * * *

UNITED STATES PATENT AND TRADEMARK OFFICE

CERTIFICATE OF CORRECTION

PATENT NO. : 6,572,300 B2
DATED : June 3, 2003
INVENTOR(S) : Altonen et al.

It is certified that error appears in the above-identified patent and that said Letters Patent is hereby corrected as shown below:

Column 3,
Line 43, “dames” should read -- domes --.

Column 5,
Line 31, “WE” should read -- TPE --.

Signed and Sealed this

Twelfth Day of April, 2005

JON W. DUDAS
*Director of the United States Patent and Trademark Office*